US011451909B1

(12) United States Patent
Notarangelo et al.

(10) Patent No.: US 11,451,909 B1
(45) Date of Patent: Sep. 20, 2022

(54) VENTED AUDIO TRANSDUCER

(71) Applicant: Apple Inc., Cupertino, CA (US)

(72) Inventors: Claudio Notarangelo, San Francisco, CA (US); Onur Ilkorur, Campbell, CA (US); Matthew A. Donarski, San Francisco, CA (US); Christopher Wilk, Los Gatos, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 17/220,890

(22) Filed: Apr. 1, 2021

(51) Int. Cl.
*H04R 7/12* (2006.01)
*H04R 9/06* (2006.01)

(52) U.S. Cl.
CPC ..... *H04R 7/127* (2013.01); *H04R 9/06* (2013.01)

(58) Field of Classification Search
CPC . H04R 7/14; H04R 7/06; H04R 7/127; H04R 7/18; H04R 7/08; H04R 31/003; H04R 9/045; H04R 9/06
See application file for complete search history.

(56) References Cited

U.S. PATENT DOCUMENTS

| | | | | |
|---|---|---|---|---|
| 6,154,556 | A | 11/2000 | Takahashi et al. | |
| 6,980,664 | B2 | 12/2005 | Goller | |
| 2006/0062422 | A1* | 3/2006 | Ono | H04R 31/006 381/423 |
| 2006/0072777 | A1* | 4/2006 | Ohashi | H04R 31/003 381/430 |
| 2020/0280806 | A1* | 9/2020 | Nagaoka | H04R 7/26 |

FOREIGN PATENT DOCUMENTS

KR 20120053944 A * 5/2012

* cited by examiner

*Primary Examiner* — Sunita Joshi
(74) *Attorney, Agent, or Firm* — BakerHostetler

(57) ABSTRACT

Implementations of the subject technology provide vented audio transducers such as vented speakers. A speaker assembly may define a first volume under a dome of the speaker and a second volume under a surround of the speaker. The first volume and the second volume may be separated by a speaker structure such as a voice coil. By venting the first volume to the second volume, the disclosed vented speakers can provide a flatter response at high frequencies and lower distortion relative to conventional speakers, by equalizing the pressure under the diaphragm during operation.

16 Claims, 5 Drawing Sheets

VENTED AUDIO TRANSDUCER

TECHNICAL FIELD

The present description relates generally to audio transducers including, for example, vented audio transducers.

BACKGROUND

Electronic devices often include speakers for generating audio output, such as for playing music. It can be challenging to implement speakers, for example in compact audio devices that provide high quality sound over a desired frequency range.

BRIEF DESCRIPTION OF THE DRAWINGS

Certain features of the subject technology are set forth in the appended claims. However, for purpose of explanation, several aspects of the subject technology are set forth in the following figures.

DETAILED DESCRIPTION

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a thorough understanding of the subject technology. However, the subject technology is not limited to the specific details set forth herein and can be practiced using one or more other implementations. In one or more implementations, structures and components are shown in block diagram form in order to avoid obscuring the concepts of the subject technology.

Audio transducers such as a speakers often include a diaphragm having a dome that forms a chamber under the dome. The chamber can also be partially defined by other assembly components such as a voice coil, a magnet, or drive circuitry. However, in some scenarios, acoustic modes under the diaphragm can generate intermodulation distortion and/or undesired peaks in the frequency response of the speaker. Intermodulation distortions and/or undesired frequency peaks can negatively impact the quality of media playback and the performance of noise cancelling operations.

Implementations of the subject technology described herein provide a speaker having a flattened response at high frequencies and a reduced intermodulation distortion, in comparison, for example, with current conventional speakers. For example, the disclosed speakers can be provided with vents that allow equalization of pressure under the diaphragm with pressure elsewhere, such as under the surround. Pressure equalization can be achieved, for example, by providing multiple (e.g., at least two) vents that fluidly couple a first volume under the dome with a second volume under the surround, the first and second volumes being at least partially separated by the voice coil. The vents can be formed by gaps between the diaphragm and the coil. The gaps can be formed by adhesive discontinuities and/or deformations or protuberances of radially extending, circumferentially spaced sections of the diaphragm.

Figure 1:
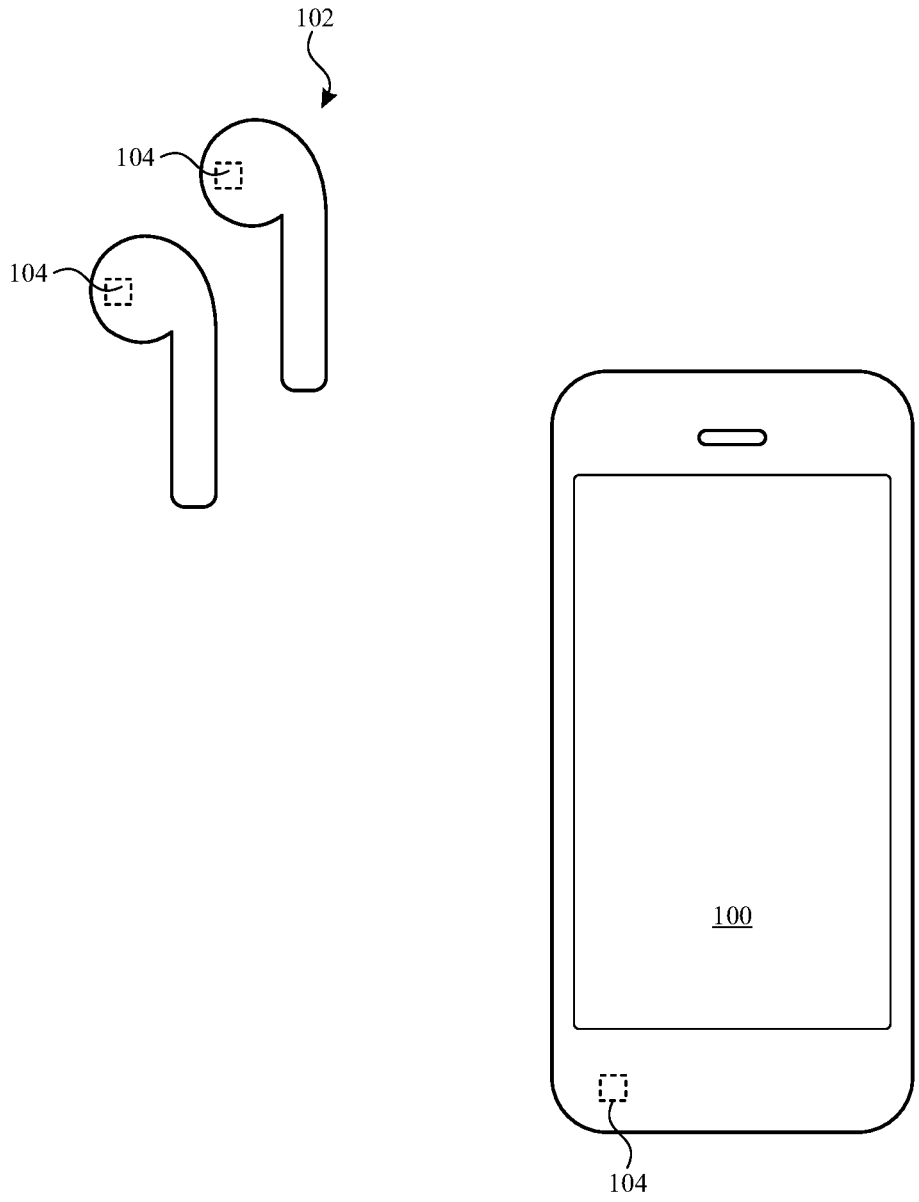
FIG. 1 illustrates example electronic devices that may include vented audio transducers in accordance with one or more implementations.

FIG. 1 illustrates an example of electronic devices that may implement the subject technology in accordance with one or more implementations. Not all of the depicted components may be used in all implementations, however, and one or more implementations may include additional or different components than those shown in the figure. Variations in the arrangement and type of the components may be made without departing from the spirit or scope of the claims as set forth herein. Additional components, different components, or fewer components may be provided.

As shown in FIG. 1, an electronic device 100 may include an audio transducer such as a microphone or a speaker, such as speaker 104. FIG. 1 also illustrates a media output device 102 that may include an audio transducer such as a microphone or a speaker, such as a speaker 104.

The electronic device 100 may be, for example, a smartphone, a portable computing device such as a laptop computer, a peripheral device (e.g., a digital camera, headphones, another audio device, or another media output device), a tablet device, a wearable device such as a smart watch, a smart band, and the like, any other appropriate device that includes an audio transducer and, for example, processing circuitry and/or communications circuitry for providing audio content to media output device(s) 102. In FIG. 1, by way of example, the electronic device 100 is depicted as a mobile smartphone device with a touchscreen.

The media output device 102 may be implemented as an audio device such as a smart speaker, headphones (e.g., a pair of speakers mounted in speaker housings that are coupled together by a headband and can be worn over-the-ear), or an earbud (e.g., an earbud of a pair of earbuds each having one or more audio transducers such as a microphone or a speaker 104 disposed in a housing that conforms to a portion of the user's ear) configured to be worn by a user, for example, either on-the-ear or in-ear (also referred to as a wearer when the audio device is worn by the user), or may be implemented as any other device capable of outputting audio, video and/or other types of media. In FIG. 1, by way of example, media output devices 102 are depicted as a pair of earbuds. Each media output device 102 may include one or more audio transducers, such as speaker 104 configured to project sound into an ear of a user, and/or other components such as one or more microphones, display components for displaying video or other media to a user processing circuitry (e.g., including memory and/or one or more processors), and communications circuitry (e.g., one or more antennas, etc.) for receiving and/or processing audio content from one or more electronic devices such as electronic device 100.

In one or more implementations, the electronic device 100 and/or the media output device 102 may be, and/or may include all or part of, electronic system discussed below with respect to FIG. 8.

Figure 2:
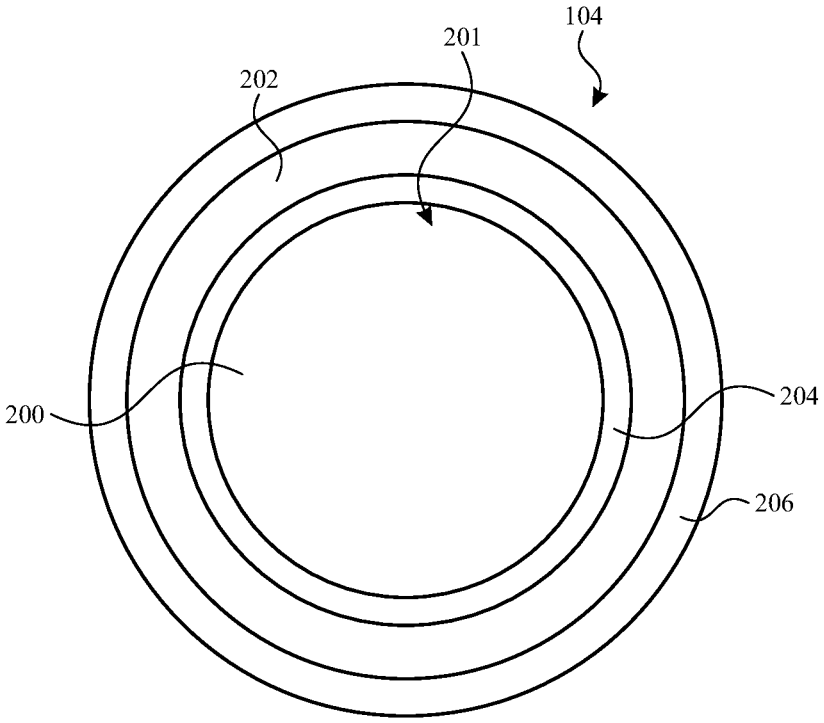
FIG. 2 illustrates an a schematic top view of an example speaker assembly in accordance with implementations of the subject technology.

FIG. 2 illustrates a top view of a speaker assembly for speaker 104, in accordance with aspects of the disclosure. As shown in FIG. 2, a speaker 104 may include a diaphragm 201 having a dome portion 200 and a neck portion 204 that extends around a periphery of the dome portion 200. Speaker 104 may also include a surround 202 that extends around a periphery of the neck portion 204, and from the neck portion 204 to a support structure such as support structure 206. Support structure 206 may be a fixed support structure (e.g., fixed to and/or relative to other portions of the speaker assembly, such as a speaker frame or a speaker housing, and/or fixed to and/or relative to other portions or components of the device in which the speaker is implemented). The surround 202 may be formed from a flexibly resilient material that suspends the diaphragm 201 movably with respect to other components of the speaker, such as a support structure 206 and/or one or more fixed magnets.

Figure 3:
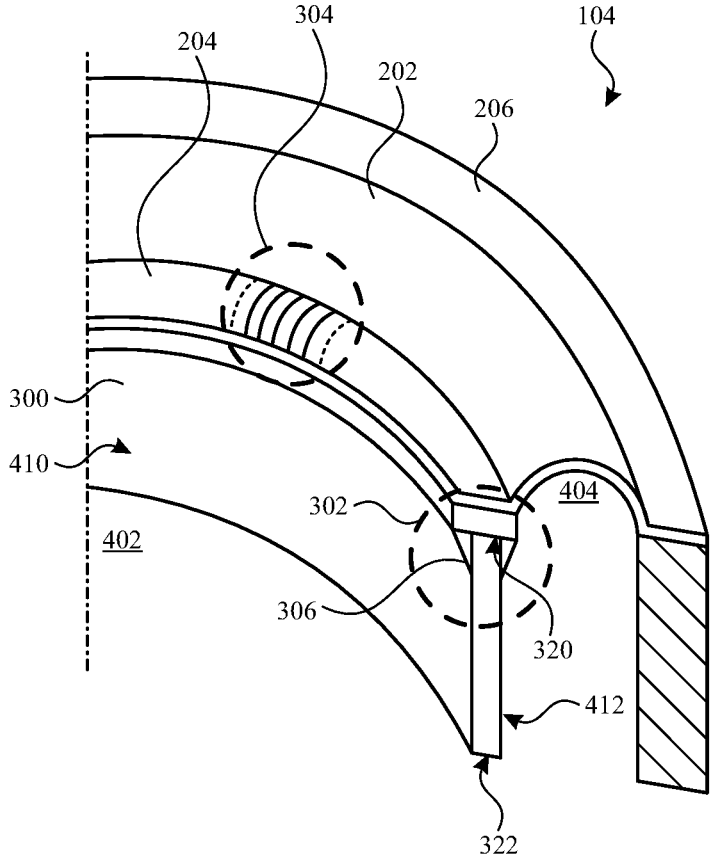
FIG. 3 illustrates a cross-sectional perspective view of a portion of the speaker assembly of FIG. 2 in accordance with implementations of the subject technology.

FIG. 3 illustrates a top perspective view of a portion of the speaker 104 of FIG. 2, in which other aspects of the speaker are shown. As shown in FIG. 3, the speaker 104 may also include a drive element, such as a coil 300 (e.g., a voice coil). The coil 300 may include a proximal end 320 that is at least partially attached to the neck portion 204 of the diaphragm 201, and a distal end 322 that extends away from the diaphragm 201 (e.g., the approximate cylinder of the coil may extend away between the proximal end 320 and the distal end 322). In the example of FIG. 3 adhesive 306 attaches a portion of a proximal end 320 to the neck portion 204 of the diaphragm 201, such as in an attached region 302. As shown in FIG. 3, the coil 300 may at least partially separate a first volume 402 that is at least partially defined by a first side 410 of the coil 300, from a second volume 404 that is at least partially defined by an opposing second side 412 of the coil 300.

FIG. 3 also illustrates how the surround 202 may extend (e.g., along a curved or arching path) from the coil 300 to the support structure 206 and may partially define the second volume 404. In this configuration, the coil 300 and the dome portion 200 are suspended by the surround 202, relative to fixed structures such as a central magnet (not shown in FIG. 3). In this way, when a current is driven through the coil 300, the coil 300 and the dome (e.g., dome portion 200) can reciprocate to generate sound. Similarly, movement of the dome portion 200 (e.g., by an incoming sound in a vented microphone implementation of a vented audio transducer) and the coil 300 relative to the central magnet may cause a current to be generated in the coil 300.

Figure 4:
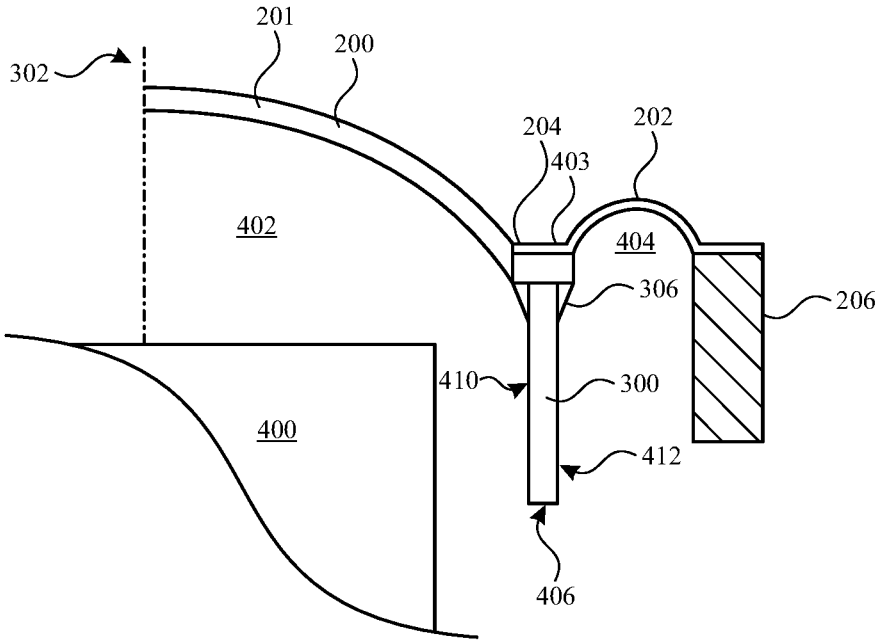
FIG. 4 illustrates a cross-sectional side view of a portion of the speaker assembly of FIG. 3 in accordance with one or more implementations of the subject technology.

In accordance with aspects of the technology, intermodulation distortions and/or undesired frequency peaks in the acoustic response of speaker 104 can be reduced by venting the first volume 402 to the second volume 404 at one or more locations. As discussed in further detail hereinafter, speaker 104 may include vents, such as vent 304, that fluidly couple the first volume 402 to the second volume 404. In one or more implementations, vent(s) 304 can help equalize the pressure in the first and second volumes 402 and 404, and thereby reduce any negative impacts of pressure under the dome (e.g., dome portion 200) on the quality of media playback and performance of noise cancelling operations FIG. 4 illustrates a cross-sectional side view of a portion of speaker 104 of FIG. 3 in the attached region 302. As shown in FIG. 4, the coil 300 may separate the first volume 402, which is at least partially defined by the first side 410 of the coil and the dome portion 200. In the cross-sectional view of FIG. 4, adhesive 306 can be seen attaching the proximal end 320 of coil 300 to the neck portion 204 of the diaphragm 201. FIGS. 3 and 4 also illustrate how support structure 206 can extend around and partially define the second volume 404, and surround 202 can extend from the coil 300 to the support structure 206 and also partially define the second volume 404. An additional volume, separate from the first volume 402 and the second volume 404 may also be formed on an opposing side of the dome portion 200.

In the example of FIG. 4, the neck portion 204 of the diaphragm 201 is attached (e.g., by adhesive 306) directly to the proximal end 320 of the coil 300, and a neck portion 403 of the surround 202 is attached to the neck portion 204 of the diaphragm 201. However, in other implementations, the neck portion 403 of the surround 202 may be attached (e.g., by adhesive 306) directly to the proximal end 320 of the coil 300, and the neck portion 204 of the diaphragm 201 may be attached to the neck portion 204 of the diaphragm 201, or the neck portion 204 and the neck portion 403 may be both attached (e.g., by adhesive 306) directly to the proximal end 320 of the coil (e.g., with or without contact or overlap between the respective neck portions), or the neck portions may be integrally formed from a common structure.

In the example of FIG. 4, an interior surface of dome portion 200 can also be seen to define at least a portion of the first volume 402. In one or more implementations, one or more speaker structures and/or components, such as a central magnet 400 may be at least partially disposed in the first volume 402. It can be seen in the cross-sectional view of FIG. 4, that the coil 300 and the dome portion 200 are suspended by the surround 202, relative to the central magnet 400, for reciprocation relative to the central magnet 400 and the support structure 206, responsive to a current through the coil 300.

In one or more implementations, in addition to the vents 304 that couple the first volume 402 and the second volume 404, the first volume 402 and the second volume 404 may be further fluidly coupled at a location 406 that is distal to the distal end 322 of the coil 300. However, without the venting provided by vents 304, the distal location of the location 406, and/or the path length along the gap between the central magnet 400 and the coil 300 and around the distal end 322 may prevent pressure equalization of the first and second volumes 402 and 404 from occurring on a time scale that is fast enough (e.g., relative to a time scale of the reciprocating motions of the dome) to prevent pressure differences between the first volume 402 and 404 from causing unwanted acoustic artifacts. In order to provide the desired pressure equalization between the first volume 402 and the second volume 404, speaker 104 may include a number of vents, each having a cross-sectional area, such that the number of vents and the cross-sectional area of each vent form a sufficient airflow path between the first volume 402 and the second volume 404 through the vents to substantially reduce and/or prevent additional airflow between the first volume 402 and the second volume 404 via the location 406 that is distal to the distal end of the coil 300, during operation of the speaker. For example, the vents 304 may reduce one or more peaks in the acoustic response of the speaker 104 at frequencies at or above, for example, 8 kHz. The vents 304 disclosed herein may reduce intermodulation distortion by as much as, or more than, forty percent (e.g., relative to the same speaker construction without any vents 304 between the first volume 402 and the second volume 404, and with the first volume 402 and the second volume 404 fluidly coupled only via the location 406).

Figure 5:
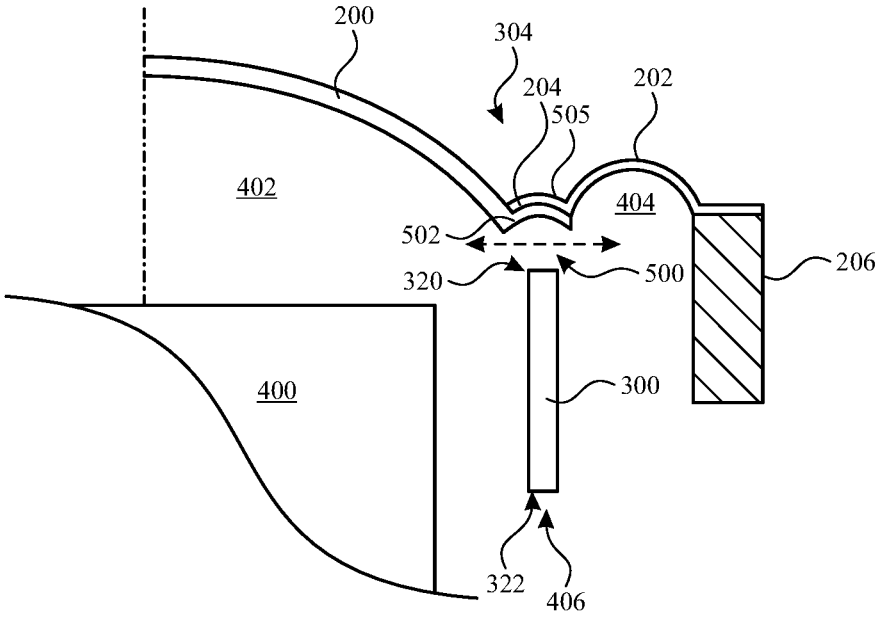
FIG. 5 illustrates a cross-sectional side view of a portion of the speaker assembly of FIG. 3, with the cross-section through a vent, in accordance with one or more implementations of the subject technology.

FIG. 5 illustrates another cross-sectional side view of the speaker 104 of FIGS. 3 and 4, at a different circumferential location on the speaker, at which a vent 304 is located. As shown, a vent 304 may be formed by a gap 500 between the neck portion 204 of the diaphragm 201 and the coil 300. The gap 500 allows airflow between the first volume 402 and the second volume 404, as indicated by the dashed arrow in FIG. 5. As illustrated in FIG. 5, the vent 304 may be formed, in part, by a gap in the adhesive 306 (see FIGS. 3 and 4) that elsewhere attaches the neck portion 204 to the proximal end 320 of the coil 300. In one or more implementations, vent 304 may also be partially defined by a protuberance 502 of the diaphragm 201 and/or a corresponding protuberance 505 of the neck portion 403 of the surround 202.

Figure 6:
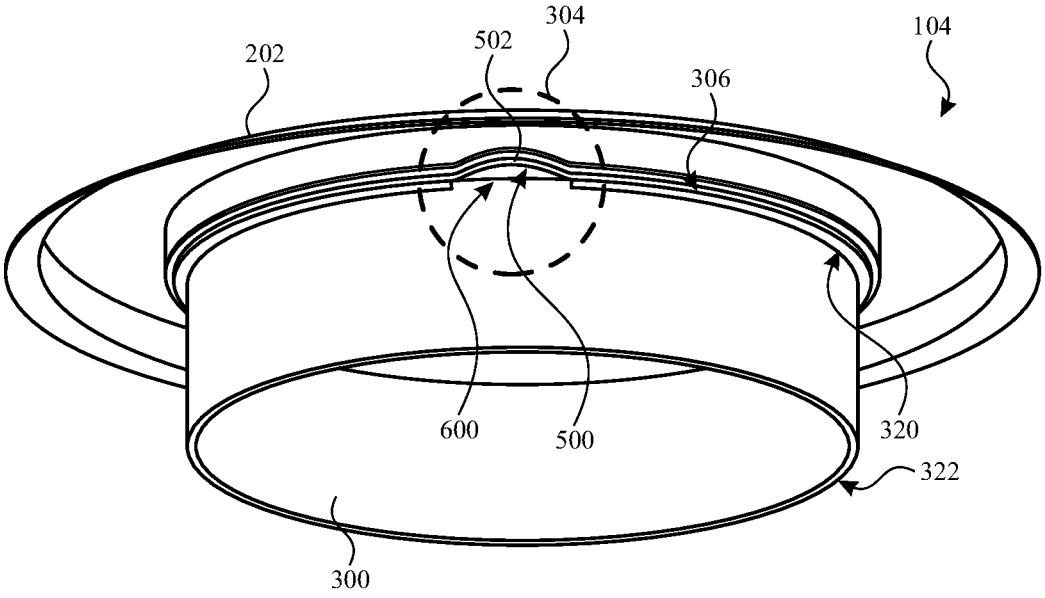
FIG. 6 illustrates a bottom perspective view of a speaker assembly having a vent in accordance with implementations of the subject technology.

FIG. 6 illustrates a bottom perspective view of the speaker 104 at the location of the vent 304, showing how the vent 304 includes a gap 500 that is formed in part by a gap 600 in a discontinuous ring of the adhesive 306, and in part by the protuberance 502 in the diaphragm. In this example, the protuberance 502 of the diaphragm 201 corresponds to a deformation of the diaphragm 201 that, moving in a circumferential direction around a central axis of the coil, rises on a curved path away from a point of adhesive contact with the proximal end 320 of the coil 300 to a peak distance from the proximal end 320, and then falls back along a symmetric curved path back into adhesive contact with the proximal end 320 of the coil 300. The height of the peak distance of the gap 500, and the circumferential width of the gap 500 along the proximal end 320 of the coil 300 may be selected to provide a gap 500 with sufficient cross-sectional area to allow airflow between the first volume 402 and the second volume 404 that is more efficient than the airflow around the distal end 322 via location 406 (e.g., efficient enough to significantly reduce or eliminate the airflow between the first volume 402 and the second volume 404 via the location 406), and that is free of substantial viscous losses in the gap that would prevent the free movement of air responsive to motions of the dome and the coil.

The number of vents 304, and/or the circumferential length of the gap 600 in the discontinuous ring of the adhesive 306 for each vent 304, may be set such that a predetermined percentage of the diaphragm (e.g., a predetermined percentage of the neck portion 204) is attached to the proximal end 320 of the coil 300. For example, in one or more implementations, the discontinuous ring of adhesive 306, and/or another attachment mechanism, may attach at least fifty percent, sixty percent, seventy percent, eighty percent, or ninety percent of the neck portion 204 of the diaphragm 201 (e.g., at least fifty percent, sixty percent, seventy percent, eighty percent, or ninety percent of a circumference of the neck portion of the diaphragm) to the coil 300. For example, a number of the vents 304 and/or the circumferential length of the gap 600 in the discontinuous ring of the adhesive 306 for each vent 304 may be set to provide an attachment strength that can withstand the force of a drop test or drop event, while providing sufficient fluid coupling between the first volume 402 and the second volume 404 to equalize the pressures in the two volumes on the same or similar time scale as the time scale of the movements or reciprocations of the dome portion 200 (e.g., in comparison with the slower time scale of airflows between the two volumes via the longer path through the distal location 406 of FIG. 4).

Figure 7:
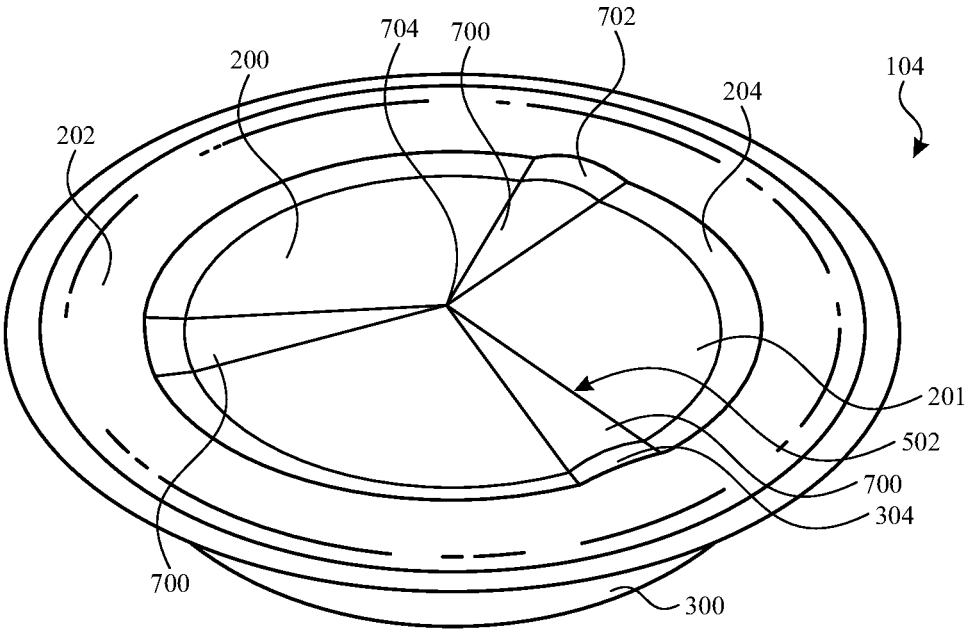
FIG. 7 illustrates a top perspective view of the speaker assembly of FIG. 6 in accordance with implementations of the subject technology.

FIG. 7 illustrates a top perspective view of the speaker 104 of FIG. 6, rotated around the central axis of the coil relative to the bottom perspective view of FIG. 6. In the example of FIG. 7, it can be seen that the speaker 104 can include multiple (e.g., at least two, three as in the example shown in the figure, or more than three) vents 304 that are each formed by a protuberance 502 of the diaphragm 201.

In the example of FIG. 7, three vents 304 are formed by three corresponding radially extending protuberances 502 that are angularly spaced apart around the diaphragm 201. As in the example of FIG. 7, the radially extending protuberances 502 may be evenly spaced apart in a circumferential (angular) direction around a central axis of the diaphragm and/or the coil 300. Evenly spacing the vents 304 (and the corresponding adhesive discontinuities and protuberances), as shown, can help prevent rocking or other unwanted motions or deformations of the dome that could be caused by asymmetrically spaced vents and/or protuberances. Providing a larger number of the vents 304 (e.g., three, four, or more than four vents) may aide in simplifying the alignment of the protuberances 502 of the diaphragm with the gaps 600 in the adhesive 306 during the manufacturing and/or assembly of the speaker.

As shown in FIG. 7, each protuberance 502 of the diaphragm 201 may include a protuberance 702 of the neck portion 204. Each protuberance 502 of the diaphragm 201 may also include a protuberance 700 of the dome portion 200. Each protuberance 700 may extend radially away from a center 704 of the dome portion 200, to the protuberance 702 of the neck portion 204. As shown in FIG. 7, each protuberance 700 of the dome portion 200 may taper toward the center 704 of the dome (e.g., dome portion 200). For example, each protuberance 700 of the dome portion 200 may taper at a rate that corresponds to a curvature (e.g., a rate of curvature) of the dome portion 200 (e.g., the dome curvature visible in, for example, FIGS. 3 and 4).

In the example of FIG. 7, the protuberances 700 on the dome portion 200 are shown extending from the neck portion 204 substantially to the center 704 of the dome. However, in other implementations, the protuberances 700 on the dome portion 200 may extend from the neck portion 204 only partway to the center 704 of the dome (e.g., half of the distance to the center 704 of the dome, two-thirds of the distance to the center 704 of the dome, three-quarters of the distance to the center 704 of the dome, or another partial distance from the neck portion 204 toward the center 704 of the dome).

In the example of FIG. 7, a speaker diaphragm (e.g., diaphragm 201) is shown, that includes a dome (e.g., dome portion 200), a neck (e.g., neck portion 204), and multiple radially extending protuberances (e.g., protuberances 502) angularly spaced apart around the speaker diaphragm. For example, each radially extending protuberance of the speaker diaphragm may include a corresponding protuberance 702 of the neck and a protuberance 700 of the dome that extends radially away from a center 704 of the dome to the protuberance of the neck. For example, each protuberance 502 of the dome may taper toward the center 704 of the dome. For example, each protuberance of the dome may taper at a rate that corresponds to a curvature of the dome.

In the examples described herein, vents 304 are provided at various locations in an audio transducer, to allow pressure equalization in a volume under a dome of the audio transducer with a volume under a surround of the audio transducer, the vents being formed by gaps between a coil of the audio transducer and the diaphragm of the audio transducer. However, in one or more implementations, vents coupling the volume under the dome of the audio transducer (e.g., first volume 402) with the volume under the surround of the audio transducer (e.g., second volume 404) also, or alternatively, be provided at other locations in the audio transducer assembly. For example, in one or more implementations, one or more vents may between the first volume 402 and the second volume 404 may be formed by openings in the coil 300. In another example, in one or more implementations, rather than attaching the coil 300 directly to the diaphragm 201 using adhesive 306, a mounting structure may be provided between the coil 300 and the diaphragm 201, and one or more vents may formed from one or more openings in the mounting structure.

Figure 8:
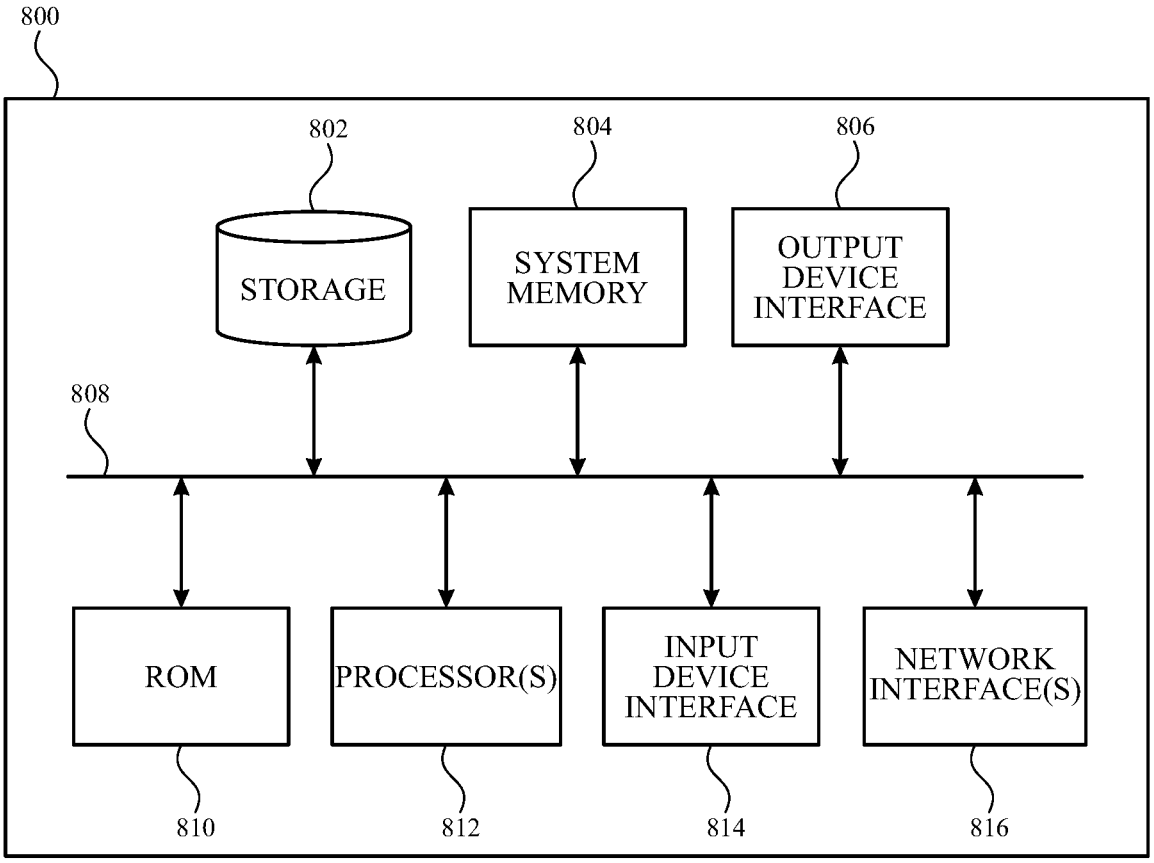
FIG. 8 illustrates an electronic system with which one or more implementations of the subject technology may be implemented.

FIG. 8 illustrates an electronic system 800 with which one or more implementations of the subject technology may be implemented. The electronic system 800 can be, and/or can be a part of, the media output device 102, or the electronic device 100, as shown in FIG. 1. The electronic system 800 may include various types of computer readable media and interfaces for various other types of computer readable media. The electronic system 800 includes a bus 808, one or more processing unit(s) 812, a system memory 804 (and/or buffer), a ROM 810, a permanent storage device 802, an input device interface 814, an output device interface 806, and one or more network interfaces 816, or subsets and variations thereof.

The bus 808 collectively represents all system, peripheral, and chipset buses that communicatively connect the numerous internal devices of the electronic system 800. In one or more implementations, the bus 808 communicatively connects the one or more processing unit(s) 812 with the ROM 810, the system memory 804, and the permanent storage device 802. From these various memory units, the one or more processing unit(s) 812 retrieves instructions to execute and data to process in order to execute the processes of the subject disclosure. The one or more processing unit(s) 812 can be a single processor or a multi-core processor in different implementations.

The ROM 810 stores static data and instructions that are needed by the one or more processing unit(s) 812 and other modules of the electronic system 800. The permanent storage device 802, on the other hand, may be a read-and-write memory device. The permanent storage device 802 may be a non-volatile memory unit that stores instructions and data even when the electronic system 800 is off. In one or more implementations, a mass-storage device (such as a magnetic or optical disk and its corresponding disk drive) may be used as the permanent storage device 802.

In one or more implementations, a removable storage device (such as a floppy disk, flash drive, and its corresponding disk drive) may be used as the permanent storage device 802. Like the permanent storage device 802, the system memory 804 may be a read-and-write memory device. However, unlike the permanent storage device 802, the system memory 804 may be a volatile read-and-write memory, such as random access memory. The system memory 804 may store any of the instructions and data that one or more processing unit(s) 812 may need at runtime. In one or more implementations, the processes of the subject disclosure are stored in the system memory 804, the permanent storage device 802, and/or the ROM 810 (which are each implemented as a non-transitory computer-readable medium). From these various memory units, the one or more processing unit(s) 812 retrieves instructions to execute and data to process in order to execute the processes of one or more implementations.

The bus 808 also connects to the input and output device interfaces 814 and 806. The input device interface 814 enables a user to communicate information and select commands to the electronic system 800. Input devices that may be used with the input device interface 814 may include, for example, alphanumeric keyboards and pointing devices (also called "cursor control devices"). The output device interface 806 may enable, for example, the display of images generated by electronic system 800. Output devices that may be used with the output device interface 806 may include, for example, printers and display devices, such as a liquid crystal display (LCD), a light emitting diode (LED) display, an organic light emitting diode (OLED) display, a flexible display, a flat panel display, a solid state display, a projector, or any other device for outputting information. One or more implementations may include devices that function as both input and output devices, such as a touchscreen. In these implementations, feedback provided to the user can be any form of sensory feedback, such as visual feedback, auditory feedback, or tactile feedback; and input from the user can be received in any form, including acoustic, speech, or tactile input.

Finally, as shown in FIG. 8, the bus 808 also couples the electronic system 800 to one or more networks and/or to one or more network nodes, such as the electronic device 100 shown in FIG. 1, through the one or more network interface(s) 816. In this manner, the electronic system 800 can be a part of a network of computers (such as a LAN, a wide area network ("WAN"), or an Intranet, or a network of networks, such as the Internet. Any or all components of the electronic system 800 can be used in conjunction with the subject disclosure.

These functions described above can be implemented in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (also referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, read-only and recordable Blu-Ray® discs, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself.

As used in this specification and any claims of this application, the terms "computer", "server", "processor", and "memory" all refer to electronic or other technological devices. These terms exclude people or groups of people. For the purposes of the specification, the terms display or displaying means displaying on an electronic device. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

To provide for interaction with a user, implementations of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; e.g., feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; e.g., by sending web pages to a web browser on a user's client device in response to requests received from the web browser.

Aspects of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

The computing system can include clients and servers. A client and server are generally remote from each other and may interact through a communication network. The relationship of client and server arises by virtue of computer programs running on the respective computers and having a client-server relationship to each other. In one or more implementations, a server transmits data (e.g., an HTML page) to a client device (e.g., for purposes of displaying data to and receiving user input from a user interacting with the client device). Data generated at the client device (e.g., a result of the user interaction) can be received from the client device at the server.

In accordance with aspects of the disclosure, a speaker is provided that includes a diaphragm having a dome portion and a neck portion that extends around a periphery of the dome portion, a coil that includes a proximal end that is at least partially attached to the neck portion of the diaphragm and a distal end that extends away from the diaphragm, in which the coil separates a first volume of the speaker that is at least partially defined by a first side of the coil and the dome portion from a second volume of the speaker that is at least partially defined by an opposing second side of the coil, and a plurality of vents that fluidly couple the first volume to the second volume.

In accordance with aspects of the disclosure, an electronic device is provided that includes a speaker, including a diaphragm having a dome portion and a neck portion that extends around a periphery of the dome portion; a coil that includes a proximal end that is at least partially attached to the neck portion of the diaphragm and a distal end that extends away from the diaphragm, where the coil separates a first volume of the speaker that is at least partially defined by a first side of the coil and the dome portion, from a second volume of the speaker that is at least partially defined by an opposing second side of the coil; and a plurality of vents that fluidly couple the first volume to the second volume.

In accordance with aspects of the disclosure, an audio transducer diaphragm is provided that includes a dome, a neck, and a plurality of radially extending protuberances angularly spaced apart around the audio transducer diaphragm.

Those of skill in the art would appreciate that the various illustrative blocks, modules, elements, components, methods, and algorithms described herein may be implemented as electronic hardware, computer software, or combinations of both. To illustrate this interchangeability of hardware and software, various illustrative blocks, modules, elements, components, methods, and algorithms have been described above generally in terms of their functionality. Whether such functionality is implemented as hardware or software depends upon the particular application and design constraints imposed on the overall system. The described functionality may be implemented in varying ways for each particular application. Various components and blocks may be arranged differently (e.g., arranged in a different order, or partitioned in a different way) all without departing from the scope of the subject technology.

It is understood that the specific order or hierarchy of steps in the processes disclosed is an illustration of example approaches. Based upon design preferences, it is understood that the specific order or hierarchy of steps in the processes may be rearranged. Some of the steps may be performed simultaneously. The accompanying method claims present elements of the various steps in a sample order, and are not meant to be limited to the specific order or hierarchy presented.

The previous description is provided to enable any person skilled in the art to practice the various aspects described herein. The previous description provides various examples of the subject technology, and the subject technology is not limited to these examples. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the disclosure described herein.

The predicate words "configured to", "operable to", and "programmed to" do not imply any particular tangible or intangible modification of a subject, but, rather, are intended to be used interchangeably. For example, a processor configured to monitor and control an operation or a component may also mean the processor being programmed to monitor and control the operation or the processor being operable to monitor and control the operation. Likewise, a processor configured to execute code can be construed as a processor programmed to execute code or operable to execute code.

The term automatic, as used herein, may include performance by a computer or machine without user intervention; for example, by instructions responsive to a predicate action by the computer or machine or other initiation mechanism. The word "example" is used herein to mean "serving as an example or illustration." Any aspect or design described herein as "example" is not necessarily to be construed as preferred or advantageous over other aspects or designs.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such as an "embodiment" may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such as a "configuration" may refer to one or more configurations and vice versa.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112(f), unless the element is expressly recited using the phrase "means for" or, in the case of a method claim, the element is recited using the phrase "step for".

What is claimed is:

1. A speaker, comprising:

a diaphragm having a dome portion and a neck portion that extends around a periphery of the dome portion;

a coil that includes a proximal end that is at least partially attached to the neck portion of the diaphragm and a distal end that extends away from the diaphragm, wherein the coil separates a first volume of the speaker that is at least partially defined by a first side of the coil and the dome portion from a second volume of the speaker that is at least partially defined by an opposing second side of the coil;

a plurality of vents that fluidly couple the first volume to the second volume; and a discontinuous ring of adhesive that attaches the proximal end of the coil to the neck portion of the diaphragm, wherein each of the vents is at least partially defined by a corresponding gap in the discontinuous ring of adhesive.

2. The speaker of claim 1, wherein each of the plurality of vents is formed, at least in part, by a corresponding gap between the neck portion and the proximal end of the coil.

3. The speaker of claim 2, wherein each of the plurality of vents is at least partially defined by a respective protuberance of the diaphragm.

4. The speaker of claim 3, wherein each respective protuberance of the diaphragm includes a corresponding protuberance of the neck portion.

5. The speaker of claim 4, wherein each respective protuberance of the diaphragm further includes a corresponding protuberance of the dome portion that extends radially away from a center of the dome portion to the corresponding protuberance of the neck portion.

6. The speaker of claim 1, wherein the discontinuous ring of adhesive attaches at least eighty percent of a circumference of the neck portion of the diaphragm to the coil.

7. The speaker of claim 1, further comprising a surround that extends around a periphery of the neck portion of the diaphragm and defines at least a portion of the second volume.

8. The speaker of claim 7, wherein each of the plurality of vents includes a corresponding protuberance of the surround.

9. The speaker of claim 1, wherein the first volume of the speaker and the second volume of the speaker are further fluidly coupled at a location that is distal to the distal end of the coil.

10. An electronic device, comprising:

a speaker, comprising:

a diaphragm having a dome portion and a neck portion that extends around a periphery of the dome portion;

a coil that includes a proximal end that is at least partially attached to the neck portion of the diaphragm and a distal end that extends away from the diaphragm, wherein the coil separates a first volume of the speaker that is at least partially defined by a first side of the coil and the dome portion from a second volume of the speaker that is at least partially defined by an opposing second side of the coil and wherein the first volume of the speaker and the second volume of the speaker are further fluidly coupled at a location that is distal to the distal end of the coil; and a plurality of vents that fluidly couple the first volume to the second volume, wherein the plurality of vents include a number of vents, each having a cross-sectional area, and wherein the number of vents and the cross-sectional area of each vent form a sufficient airflow path between the first volume and the second volume to substantially prevent additional airflow between the first volume and the second volume via the location that is distal to the distal end of the coil during operation of the speaker.

11. The electronic device of claim 10, wherein the speaker further comprises a magnet disposed at least partially within the first volume.

12. The electronic device of claim 11, wherein the speaker further comprises:

a support structure that extends around and partially defines the second volume; and a surround that extends from the coil to the support structure and partially defines the second volume.

13. The electronic device of claim 12, wherein each of the plurality of vents is formed, at least in part, by:

a corresponding gap between the neck portion and the proximal end of the coil; and a respective protuberance of the diaphragm.

14. An audio transducer diaphragm, comprising:

a dome;

a neck; and a plurality of radially extending protuberances angularly spaced apart around the audio transducer diaphragm, wherein each radially extending protuberance of the audio transducer diaphragm includes a corresponding protuberance of the neck and a protuberance of the dome that extends radially away from a center of the dome to the protuberance of the neck.

15. The audio transducer diaphragm of claim 14, wherein each protuberance of the dome tapers toward the center of the dome.

16. The audio transducer diaphragm of claim 15, wherein each protuberance of the dome tapers at a rate that corresponds to a curvature of the dome.

* * * * *